United States Patent [19]

Query

[11] 4,187,122

[45] Feb. 5, 1980

[54] DISHWASHING APPARATUS

[76] Inventor: Grady W. Query, P.O. Box 18452, Charlotte, N.C. 28218

[21] Appl. No.: 958,522

[22] Filed: Nov. 7, 1978

[51] Int. Cl.[2] ..... B08B 3/02

[52] U.S. Cl. ..... 134/95; 134/104; 134/200; 137/209

[58] Field of Search ..... 134/58 D, 94, 95, 102, 134/104, 100, 115 R, 200; 137/209, 412, 624.11

[56] References Cited

U.S. PATENT DOCUMENTS

| | | | |
|---|---|---|---|
| 2,834,364 | 5/1958 | Federighi et al. | 134/94 X |
| 3,076,468 | 2/1963 | Belt | 134/102 |
| 3,707,160 | 12/1972 | Query | 134/95 X |
| 3,949,772 | 4/1976 | Hartmann | 134/104 X |
| 4,088,145 | 5/1978 | Noren | 134/104 |

FOREIGN PATENT DOCUMENTS

| | | | |
|---|---|---|---|
| 1303049 | 7/1962 | France | 134/102 |
| 90554 | 11/1967 | France | 134/115 R |

*Primary Examiner*—Robert L. Bleutge

[57] ABSTRACT

A dishwashing apparatus is disclosed comprising an air pressure system maintaining constant pressure on liquid treating agents in a plurality of storage tanks, a dishwashing compartment and an electrically operated system to control the flow of the liquid treating agents into the dishwashing compartment.

22 Claims, 13 Drawing Figures

FIG. 6
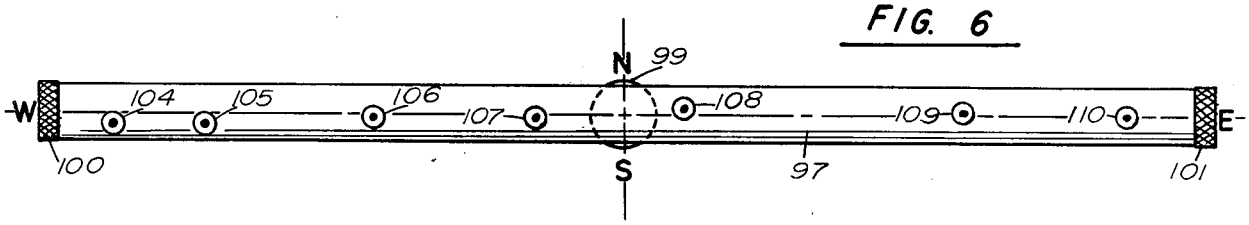
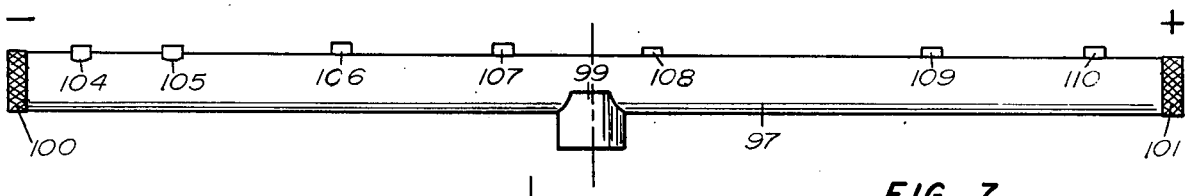
FIG. 7
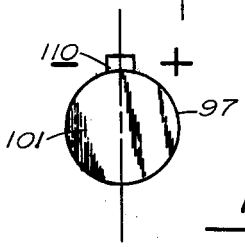
FIG. 8
FIG. 9
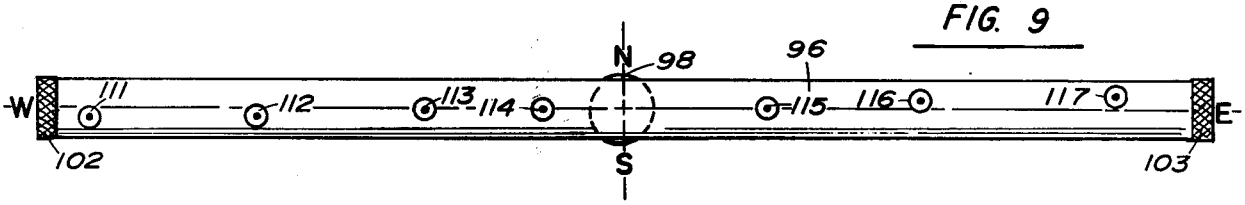
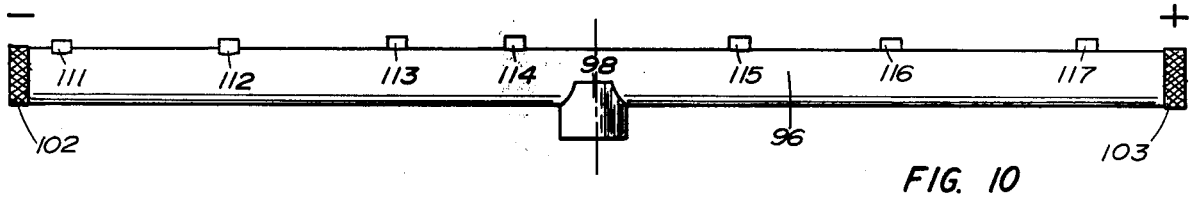
FIG. 10
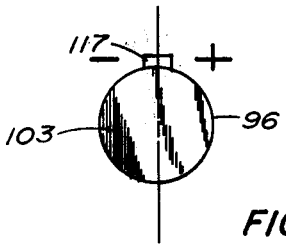
FIG. 11

| NOZZLE PLACEMENT CHART | | | | | | | | |
|---|---|---|---|---|---|---|---|---|
| | Point of Entry | | | | Angle of Entry | | | |
| Nozzle No. | N | S | E | W | 1st ∠ | | 2nd ∠ | |
| | | | | | + | − | + | − |
| 104 | | 5/32" | | 9·5/16" | 2° | | 20° | |
| 105 | | 13/64" | | 7·1/2" | 2° | | 20° | |
| 106 | | 1/8" | | 4·1/2" | 0° | | 12° | |
| 107 | | 1/16" | | 1·5/8" | 0° | | 5° | |
| 108 | 1/16" | | 1·1/8" | | 0° | | | 5° |
| 109 | 3/32" | | 6·3/16" | | 0° | | | 12° |
| 110 | 0 | | 9·5/32" | | 0° | | | 5° |
| 111 | | 3/16" | | 9·7/16" | | 30° | 20° | |
| 112 | | 3/16" | | 6·1/2" | | 3° | 20° | |
| 113 | | 0 | | 3·1/2" | 0° | 0° | 0° | |
| 114 | | 0 | | 1·3/8" | 0° | | 0° | |
| 115 | 0 | | 2·5/8" | | 0° | | | 13° |
| 116 | 1/8" | | 5·5/8" | | 0° | | | 13° |
| 117 | 5/32" | | 8·7/8" | | 2° | | | 0° |

FIG. 13

DISHWASHING APPARATUS

This invention relates to a dishwasher and more particularly to a dishwasher for use where relatively large numbers of dishes must be handled and cleaned within relatively short intervals of time.

In a restaurant or similar facility, a need exists to handle and clean large numbers of dishes within a relatively short interval of time. Dishwashing devices have been designed to deliver various liquid treating agents into the dishwashing apparatus for various purposes. Some dishwashing devices have packaged liquid treating agents in glass jars or jugs mounted near the dishwasher apparatus. Those dishwashing devices present the possiblity of contamination resulting from dropping and breaking such containers. Those devices also have other problems and deficiencies when compared with the present invention.

Query, in U.S. Pat. No. 3,707,160, patented Dec. 26, 1972, provides for bulk quantities of liquid treating agents to be retained in storage reservoirs remote from the dishwashing apparatus. The present invention improves on that concept by placing storage reservoir means onto the dishwashing apparatus itself. The present invention is, therefore, more compact, requiring less room, and adding much convenience and many other advantages.

The present invention also contains a unique configuration for the nozzles of the spray arms within the dishwashing compartment of the dishwashing apparatus.

The present invention also provides for a unique self-cleaning strainer system for the dishwashing apparatus.

The present invention also provides for a pressurized system for inserting the liquid treating agents into the dishwashing compartment of the dishwashing apparatus at various intervals of the wash cycle.

An object of the present invention is to provide a dishwashing apparatus with storage reservoir means secured onto the dishwashing apparatus.

Another object of the present invention is to provide a dishwashing apparatus with storage reservoir means secured onto the dishwashing apparatus and with liquid treating agents, stored within the storage reservoir means, inserted into the dishwashing apparatus by a pressurized system.

A further object of the present invention is to provide a dishwashing apparatus with a self-cleaning strainer system for the dishwashing compartment of the dishwashing apparatus.

Still another object of the present invention is to provide a dishwashing apparatus with a system for insertion of the liquid treating agents into the dishwashing compartment of the dishwashing apparatus during the washing cycle.

Another object of the present invention is to provide a dishwashing apparatus with a unique nozzle arrangement on the spray arms within the dishwashing compartment of the dishwashing apparatus for highly efficient spraying.

A further object of the present invention is to provide a dishwashing apparatus in which liquid treating agents are inserted into the dishwashing compartment by a pressurized system providing for a more precise dosage of liquid treating agents into the dishwashing compartment.

Another object of the present invention is to place the pressurized system for providing pressure on the liquid treating agents onto the dishwashing apparatus.

Another object of the present invention is to eliminate the need for external storage reservoir means for liquid treating agents which are to be inserted into the dishwashing apparatus.

These and other objects and features of the invention will be apparent from the following description and appended claims.

Briefly, the invention comprises a dishwashing apparatus which utilizes liquid treating agents in dishwashing. A dishwashing compartment holds objects to be washed. A plurality of storage reservoir means is operative to store liquid treating agents. A plurality of storage resevoir means is physically secured onto the dishwashing apparatus. An air pressure means is operative to maintain a constant pressure on the liquid treating agents in the plurality of storage reservoir means. Connecting means is secured between the plurality of storage reservoir means and the dishwashing compartment. Connecting means provides a means for the liquid treating agents to flow into the dishwashing compartment. Flow switch means is electrically controlled. The flow switch means is operative to permit the liquid treating agents to flow through the connecting means into the dishwashing compartment at pre-determined intervals. The air pressure means comprises an air compressor means operative to take air from the atmosphere and to increase the air pressure. Air storage means is connected to the air compressor means and is operative to store the air. Switch means is operative to control the air compressor means. Calibration means is operative to monitor air pressure in the air storage means. Regulator means is operative to reduce the air pressure in the air storage means to an operational level. A manifold receives air pressure from the regulator means and distributes the air pressure to the plurality of storage reservoir means. A constant pressure is placed on the liquid treating agents in the storage reservoir means. A manifold calibration means is connected to the manifold and is operative to monitor air pressure at the manifold. A pressure relief means is connected to the manifold and is operative to aid in maintaining a pre-designated pressure in the manifold. The plurality of storage reservoir means are physically located on the dishwashing apparatus both above and below the dishwashing compartment. The connecting means comprises a plurality of connectors each secured to one of the plurality of storage reservoir means. The plurality of connectors provides a means for the liquid treating agents to flow into a cup and then into the dishwashing compartment. The cup has an opening in it. The cup also has an off-set device which is operative to allow the liquid treating agents to flow into the dishwashing compartment, while not allowing any liquids to flow back out through the cup. A switch means comprises timer means controlling solenoid valve means. The solenoid valve means open at predetermined intervals to allow the flow of the liquid treating agents into the dishwashing compartment. The dishwashing compartment comprises a bottom which is a reservoir pan operative to hold liquids. The reservoir pan has a plurality of sloping bottoms and a drain valley at the intersection of each of the plurality of sloping bottoms. The dishwashing compartment has a sump in the lowest portion of the reservoir pan. The drain valley terminates into the sump. A plurality of filter means covers the sump. The plurality of filter means may comprise an upper filter screen with large openings and a lower filter screen with smaller openings. The dishwashing apparatus further comprises water input means connected into the sump. The water input means is operative to place water into the dishwashing compartment and to spray debris from the lower filter screen simultaneously. The dishwashing compartment further comprises a dump plunger. The dump plunger is inserted into a drain line connector. When the dump plunger is seated in the drain line connector, liquids remain in the dishwashing compartment. When the dump plunger is removed from the drain line connector, liquids in the dump plunger will flow out through the drain line connector. The dump plunger is hollow. When liquids rise above the dump plunger, liquids will flow down through the hollow dump plunger and out of the dishwashing compartment, even when the dump plunger is seated in the drain line connector. The length of the hollow dump plunger predetermines the heighth of the liquids level in the dishwashing compartment. A sealing seat is connected to the end of the dump plunger. The sealing seat has sharply curved sides so that when the dump plunger falls onto the drain line connector at an angle, the seal will still be effected between the dump plunger and the drain line connector. A water supply line is located at the bottom of the sump and is operative for liquids to flow through when being re-circulated within the dishwashing compartment. A plurality of ledges are connected to the reservoir pan inside the sump. The plurality of ledges are operative to support the plurality of filter means. A guide is connected to the reservoir pan inside the sump and guides the dump plunger.

The invention will be more fully understood from the following detailed description and appended claims when taken with the drawings in which:

Figure 4:
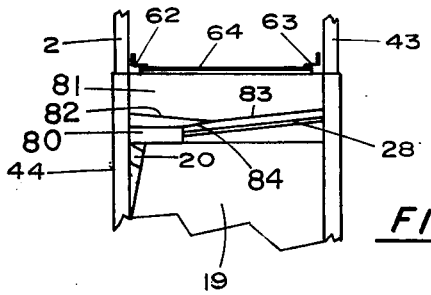

FIG. 4 is a cut-off view of the lower portion of the dishwashing compartment 75 taken from the right side of the dishwashing apparatus 1, with the door (not shown) removed and slides 41 and 132 removed.

Figure 5:
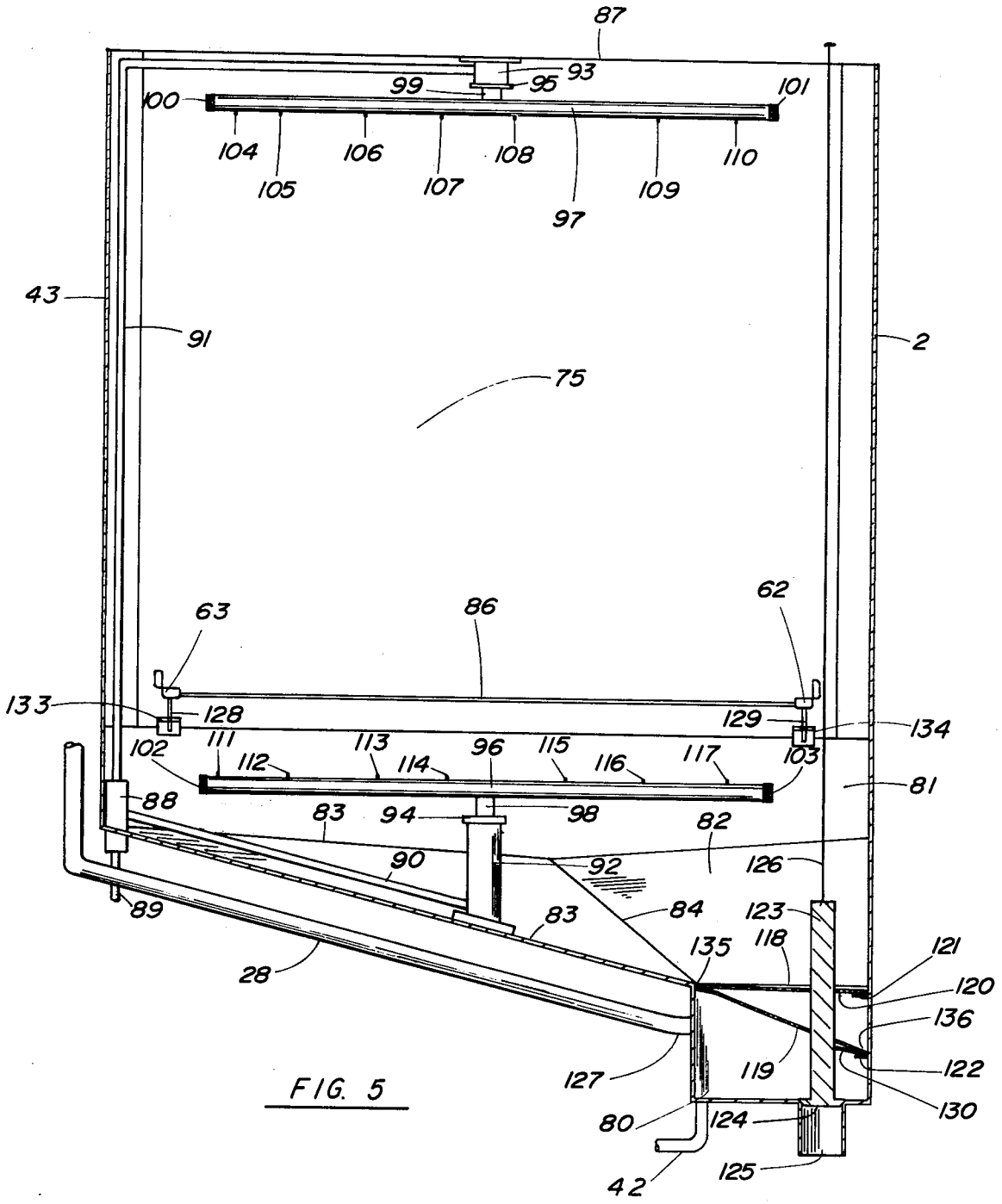

FIG. 5 is a blown-up view of the dishwashing compartment taken from the left side of the dishwashing apparatus.

FIG. 6 is a bottom view of the upper spray arm 97 showing the North, South, East and West axes for reference for the point of entry of the spray nozzles.

FIG. 7 is a side view of upper spray arm 97 showing the plus (+) and minus (−) axes for the primary angle of entry for the spray nozzles 104–110 on upper spray arm 97.

FIG. 8 is an end view from the plus (+) end of FIG. 7 showing the plus (+) and minus (−) axes for the secondary angle of entry for spray nozzles 104–110, showing spray nozzle 110.

FIG. 9 is a top view of lower spray arm 96 showing the North, South, East and West axes for the point of entry of the spray nozzles.

FIG. 10 is a side view of the lower spray arm 96 showing the plus (+) and minus (−) axes for the primary angle of entry for the spray nozzles 111–117 of the lower spray arm 96.

FIG. 11 is an end view of the lower spray arm 96 from the plus (+) end of FIG. 10 showing the plus (+) and minus (−) axes for the secondary angle of entry for spray nozzles 111–117, showing the spray nozzle 117.

Figure 12:
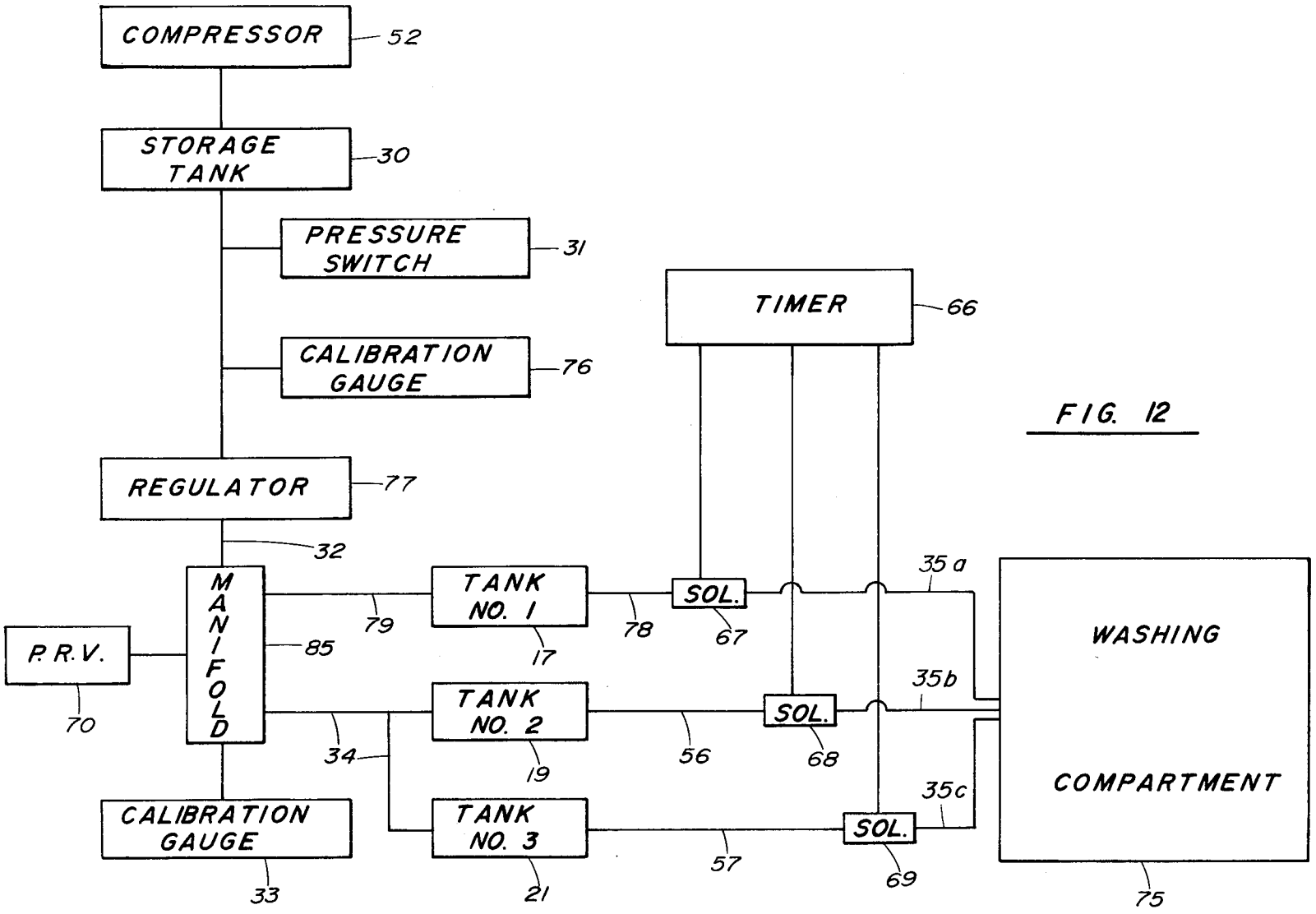

FIG. 12 is a black box diagram of the air pressure system of the dishwashing apparatus.

FIG. 13 is a nozzle placement chart showing the point of entry and angle of entry for each of the nozzles on lower spray arm 96 and upper spray arm 97.

Figure 1:
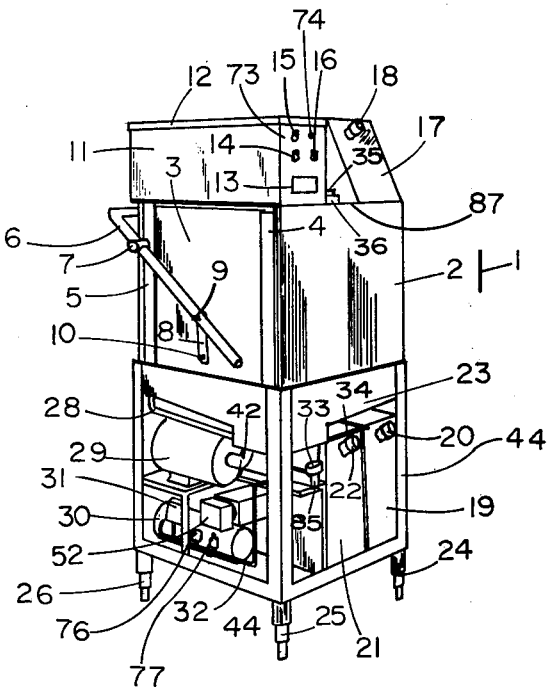
FIG. 1 is a perspective view of the left side and the front of the dishwashing apparatus.

Referring now to the drawings, FIG. 1 is a perspective view of the left side and the front of the dishwashing apparatus 1.

Figure 2:
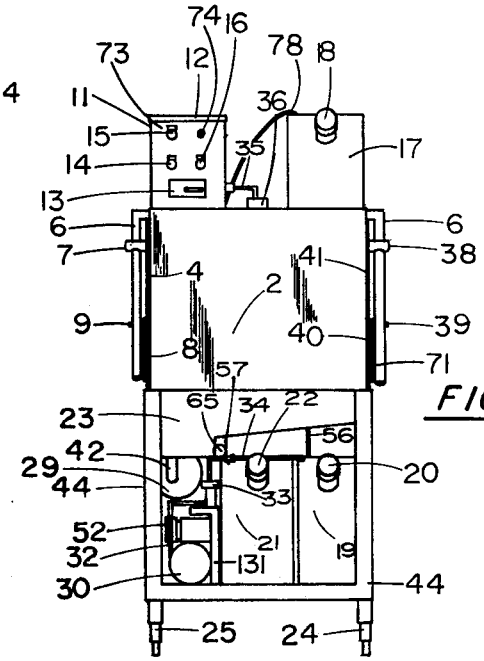
FIG. 2 is a front view of the dishwashing apparatus.

FIG. 2 is a front view of the dishwashing apparatus 1.

Figure 3:
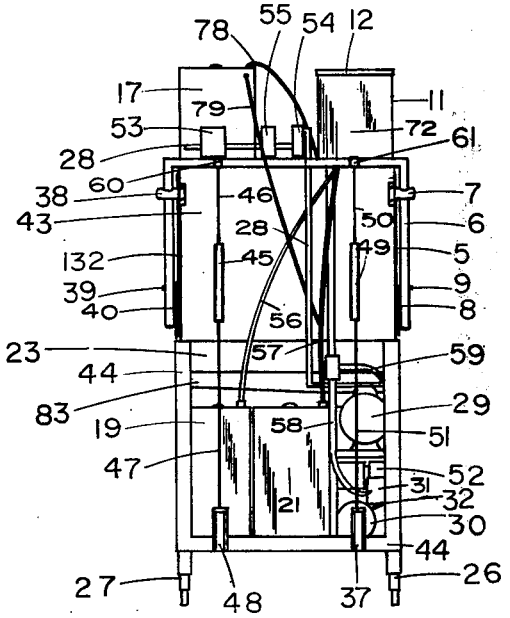
FIG. 3 is a back view of the dishwashing apparatus.

FIG. 3 is a back view of the dishwashing apparatus 1.

FIG. 1 shows a perspective view of the left side of the front of the dishwashing apparatus 1. The left door 3, front slide 4 and rear slide 5 are secured to the dishwashing apparatus 1, and serves as guides for the left door 3. Lifting arm 6 is operative to raise the left door 3 of the dishwashing apparatus 1. The left side door lifting arm 6 also extends around the dishwashing apparatus 1 to operate to open the right door (not shown). Lifting arm 6 is connected to bar 8 by pin 9 which extends through lifting arm 6 into bar 8. Pin 10 extends through bar 8 into left door 3. Pivot device 7 serves as a pivot for lifting arm 6 so that when the lifting arm 6 is pressed downward to the rear of the lifting arm 6, the forward side of the lifting arm 6 rises, therefore, raising the left door 3 and the right door (not shown). Pivot 38 acts similarly for the right side door (not shown). Electrical compartment access panel 11 is secured above the dishwashing compartment 75. Electrical compartment access panel 11 is attached to the electrical compartment 72 which has a cover 12. Electrical compartment 72 has an electrical compartment access panel 11, a cover 12 and a front 73. Various electrical components for the dishwashing apparatus 1 are located within the electrical compartment 72. On front 73 are located various controls. Cycle counter 13, start button 14, on-off switch 15, manual fill button 16 and power light 74 are located on the front 73 of electrical compartment 72. Various storage reservoirs are located on the dishwashing apparatus 1. Storage tank 17 is located above the dishwashing compartment 75. Storage tanks 19 and 21 are located below the dishwashing compartment 75. Storage tank 17 has a fill cap 18. Storage tank 19 has a fill cap 20. Storage tank 21 has a fill cap 22. These storage tanks, or reservoirs, 17, 19 and 21 may contain any liquid treating agents such as rinse-aids, sanitizers, or detergents. A reservoir pan 23 is located in the bottom of dishwashing compartment 75. The dishwashing apparatus 1 is supported by adjustable legs 24, 25, 26 and 27. A machine support structure 44 comprising a bottom perimeter, four up-right sections and four connectors for the adjustable legs 24, 25, 26 and 27 act as support for the dishwashing compartment 75. Mechanical support frame 131 is secured to the machine support structure 44 and supports the air storage tank 30, air compressor 52, and the electrical motor and pump 29, and manifold 85. Bracket 37 and bracket 48 are attached to machine support structure 44. Connecting rod 51 is connected between bracket 37 and spring 49. Connecting rod 50 is connected between spring 49 and clamp 61. Clamp 61 is secured to lifting arm 6. Connecting arm 47 is connected between bracket 48 and spring 45. Connecting rod 46 is connected between spring 45 and clamp 60. Clamp 60 is secured to lifting arm 6. Spring 45 and spring 49 serve to provide proper tension on lifting arm 6 to counterbalance the weight of door 3 and the other door (not shown). Tension on spring 45 and spring 49 may be adjusted by a securing nut (not shown) at brackets 37 and 48. The right side door (not shown). works similarly to the left side door 3. Pivot device 38 works similarly to pivot device 7. Pin 39 attaches through lifting arm 6 and connects to bar 40. Bar 40 connects through lifting arm 6 to the right side door (not shown). The right side door (not shown) is guided by front slide 41 and rear slide 132. Door latch 71 secures the right side door (not shown). Left door 3 and the right door (not shown) would be raised and lowered simultaneously, and therefore, secured simultaneously by door latch 71. The dishwashing apparatus 1 is designed to operate on electrical power which may be supplied by any source. Shown in the drawings are various electrical conduits which are utilized to supply power to various electrical components. For example, electrical conduit 58 connects between air pressure switch 31 and electrical compartment 72. Electrical conduit 59 connects between electrical conduit 58 and electrical motor and pump 29. Water temperature gauge 65 monitors the temperature of the water in reservoir pan sump 80.

FIG. 4 is a cut-off view of the lower portion of the dishwashing compartment 75 taken from the right side of the dishwashing apparatus 1, with the door (not shown) removed and slides 41 and 132 removed. FIG. 5 also shows a cut-off view of storage tank 19 and fill cap 20 on storage tank 19. The front 2 and the back 43 of the dishwashing compartment 75 are shown. Dishes may be placed into racks which may be placed onto the slides 62 and 63 in the dishwashing compartment 75. Slides 62 and 63 are connected by braces 64 and 86. The bottom of reservoir pan 23 is angled in such a manner to cause water that has circulated in dishwashing compartment 75 to flow toward the reservoir pan 23 and reservoir pan sump 80. The reservoir pan 23 has sloping bottoms 82 and 83. Reservoir pan 23 has a side 81 and three other sides (not shown), completing the circumference of the reservoir pan 23. A drain valley 84 exists at the point of intersection of sloping sides 82 and 83, and acts to aid in draining the water down into the reservoir pan sump 80.

FIG. 5 shows a blown-up view of the dishwashing compartment 75 taken from the left side of the dishwashing apparatus 1. Water flows from electrical motor and pump 29 through water distribution line 89 to water distribution manifold 88. Water passes from the water distribution manifold 88 through water distribution line 90 to the lower spray arm base 92. Water passes from water distribution manifold 88 by water distribution line 91 to upper spray arm base 93. Emanating from the lower spray arm base 92 is lower spray arm bearing 94 on which the lower spray arm 96 is mounted at T-section 98 of lower spray arm 96. Emanating from the upper spray arm 93 is upper spray arm bearing 95 on which the upper spray arm 97 is mounted at T-section 99 of upper spray arm 97. Lower spray arm 96 has spray arm caps 102 and 103. Upper spray arm 97 has spray arm caps 100 and 101. These spray arm caps may be removed by hand for cleaning or dismantling. Nozzles 104–110 are secured within upper spray arm 97. Nozzles 111–117 are secured within lower spray arm 96. Water circulating into the upper and lower spray arms cause the upper and lower spray arms to revolve, thereby spraying a specific pattern of water over a pre-designated surface within the dishwashing compartment 75. When the water flow is stopped, the upper and lower spray arms cease revolving. Slide 63 has located near each end an adjusting and support screw, adjusting and support screw 128 and one not shown. Adjusting and support screw 128 adjusts into bracket 133 which is secured to reservoir pan 23. The adjusting and support screw (not shown) is connected to a bracket not shown which is also connected to reservoir pan 23. Slide 62 has located near each end an adjusting and support screw, adjusting and support screw 129 and one not shown. Adjusting and support screw 129 adjusts into bracket 134 which is secured to reservoir pan 23. FIG. 5 shows top 87 of dishwashing compartment 75. At the end of the washing cycle, an electric solenoid, not shown, which is controlled by a timer raises dump plunger connecting rod 126. Dump plunger connecting rod 126 is attached to dump plunger 123. Dump plunger 123 acts as both a dump plunger and an over-flow drain. Dump plunger 123 is hollow so that if water were to rise above it, the water would drain down through the center of dump plunger 123. The length of the dump plunger 123 depends upon the amount of water desired in the reservoir pan 23 by the designer of the system. Dump plunger 123 has a sealing seat 124. Sealing seat 124 seals into drain line connector 125, therefore, when the dump plunger connecting rod 126 is raised, dump plunger 123 is raised, lifting sealing seat 124 from drain line connector 125, thereby allowing the water in the reservoir pan 23 to drain down the drain line connector 125. The dump plunger 123 is especially designed to have a flat top and a sharply angled concave surface down to a flat bottom. Even if the dump plunger 123 is slightly angled, the configuration of the sealing seat 124, along with the weight of the dump plunger 123, would keep an effective seal at the drain line connector 125. Dump plunger guide 130 is attached to reservoir pan 23 and acts to guide the dump plunger 123 with sealing seat 124 toward the drain line connector 125.

The invention comprises a unique, self-cleaning strainer system. The water input pipe 28 has an angled section 127 which enters the reservoir pan sump 80. Within the reservoir pan sump 80 are an upper screen 120 and lower screen 119. Upper screen 120 is supported by the edge 118 and edge 135 of reservoir pan sump 80 and a ledge 121. Lower screen 119 is supported by the edge 135 of reservoir pan sump 80 and ledge 122. Edges 118 and 135 provide two sides of support for the upper screen 120. Lower screen 119 is angled downward and is, therefore, angled below edge 118, but is supported by edge 135 along with ledge 122. The upper screen 120 may have large holes so that the upper screen may catch the larger debris. The lower screen 119 may have smaller holes so that it may trap the smaller debris. One feature of the self-cleaning strainer system is that when water enters at angled section 127, the water flows through lower screen 119 and clears the screen of particles of debris which may have deposited at the lower end 136 of lower screen 119. The self-cleaning strainer system is advantageous for many reasons. Since the dishwashing apparatus 1 is utilized for the washing of many dishes and may have so many cycles in a normal work day, it is important to keep the strainer system clean of debris so that proper volumes of water will be utilized by the dishwashing apparatus 1 in order to maintain the equipment properly and obtain the proper cleaning objective. The present invention enables the strainer, which would collect the smaller particles, to be sprayed on a regular basis every cycle, thereby maintaining a cleaner surface and adding to the efficiency and capability of the dishwashing apparatus 1.

FIG. 12 shows a block diagram of the air pressure and liquid treating agents insertion system. The air system of the dishwashing apparatus 1 places air pressure on the liquid treating agents in storage tanks 17, 19 and 21. Air compressor 52 takes air from the atmosphere and places it at a higher pressure in air storage tank 30. Air then passes through tubing into air pressure switch 31. Air pressure switch 31 controls air compressor 52, at pre-determined on and off pressures. The calibration gauge 76 monitors the pressure in air storage tank 30. Pressure regulator 77 reduces pressure in air storage tank 30 to an operational level. Air then proceeds through tubing 32 into manifold 85. Calibration gauge 33 monitors air pressure on the low pressure side of the system at the manifold 85. Pressure relief valve 70 is attached to manifold 85 and functions as a safety valve. Out of manifold 85 comes a regulated pressure which is placed on the storage tanks 17, 19 and 21. A pressure supply tube 79 provides the air pressure to storage tank 17. A pressure supply tube 34 provides the air pressure to storage tanks 19 and 21. The purpose of the air pressure system is maintaining constant pressure on the liquid treating agents stored in the storage tanks 17, 19 and 21 so that the agents will readily flow when allowed into the dishwashing compartment 75. Supply tube 78 connects storage tank 17 to solenoid 67. Supply tube 56 connects storage tank 19 to solenoid 68. Supply tube 57 connects storage tank 21 to solenoid 69. Solenoids 67, 68 and 69 are physically located within electrical compartment 72, and act as electrically controlled switches to allow flow of the liquid treating agents from the storage tanks 17, 19 and 21. The opening and closing of solenoids 67, 68 and 69 are pre-determined electrically by timer 66. Liquid treating agents dump tube 35 places the chemicals into cup 36. Cup 36 is off-set so that there will be no splashing up through the dishwashing compartment 75 out of cup 36. The liquid treating agents flow through the off-set cup 36 into dishwashing compartment 75. Liquid treating agents dump tube 35 comprises dump tubes 35*a*, 35*b* and 35*c*. Dump tube 35*a* is connected between solenoid 67 and dump cap 36. Dump tube 35*b* is connected between solenoid 68 and dump cap 36. Dump tube 35*c* is connected between solenoid 69 and dump cap 36.

Water is placed into the dishwashing apparatus 1 by a water input system. Water enters input pipe 28. From the water input pipe 28 the water enters into a water line pressure regulator and strainer 53. The water then enters a water supply line solenoid 55. Water supply line solenoid 55 is controlled by a predetermined timer to supply water to the dishwashing apparatus 1 at predetermined, desired times for appropriate wash cycles. When the solenoid 55 allows water to pass, water enters a vacuum breaker 54. Vacuum breaker 54 allows water to pass through into the dishwashing apparatus 1, but does not allow the water to back up into the incoming water line, or solenoid 55. Water line pressure regulator and strainer 53, vacuum breaker 54 and water supply line solenoid 55 are installed within water input pipe 28. Water input pipe 28 has an angled section 127 at the input to reservoir pan sump 80. Water fills to a predetermined level within the reservoir pan 23 and then the water flow is stopped by solenoid 55. Simultaneous with the closing of solenoid 55, electric motor and pump 29 is activated, causing the water to flow through water supply line 42 into the electric motor and pump 29.

The purpose of the dishwashing apparatus 1 is to wash large amounts of dishes, utensils and glasses, etc. as efficiently, quickly, and safely as possible. To operate the dishwashing apparatus 1, the operator would have a rack of dishes, glasses, utensil, etc. which need washing. Door latch 71 is released due to the tension created by springs 45 and 49 on the door 3 and one not shown, and the door will rise. The rack would then be slid into the dishwashing compartment 75 on dish rack slides 62 and 63. The rack would then be centered between brace 64 and bracket 86 for proper spray pattern efficiency. The operator would then press downward on lifting arm 6, thereby closing door 3 and the door not shown. The doors would then be held in a closed position by the spring-loaded door latch 71. The operator would then turn the "on-off" switch 15 to the on position. Power light 74 will indicate that the dishwashing apparatus 1 is ready to operate. On the initial cycle, manual fill button 16 would be pressed until the water over-flows into drain 125 through dump plunger 123. This function may be performed prior to placing the dish rack into the dishwashing compartment 75. After the first cycle, this step would be eliminated as the rinsing water from the prior cycle is held in reservoir pan 23 for use in the next cycle. After the rack is in and the doors are closed, start button 14 is pressed. Electric motor and pump 29 will be activated. Simultaneously, timer 66 will activate solenoid 68 which will inject liquid treating agents, which may be detergent stored in the storage tank 19, into the dishwashing compartment 75. The electric motor and pump 29 cause water to be circulated, as previously explained, and to be sprayed over the previously placed rack by spray arms 96 and 97. After a pre-determined time period, electric means is activated to raise dump plunger 123, allowing the dirty water within the dishwashing compartment 75 to drain out through drain line connector 125. Debris in the dirty water is collected by the upper and lower screens 119 and 120. Water supply line solenoid 55 is activated to allow fresh water to enter the dishwashing compartment 75. The water enters at angled section 127 of water input pipe 128 and sprays through lower screen 119. The debris on lower screen 119 is swept down to lower end 136 of the lower screen 119. The larger debris held on upper screen 120 allows water to flow around it. This debris does not need to be removed on every cycle. The large sized debris on upper screen 120 may be removed at various intervals by the operator. When the water is sprayed through lower screen 119, some of the debris, along with soap suds, etc., will leave the dishwashing compartment 75 through the drain line connector 125. After a short interval, the dump plunger 123 will be lowered onto and will seal the drain line connector 125. Water will continue to enter the dishwashing compartment 75 and will fill the reservoir pan 23 to a predetermined level, at which time electrical means will be deactivated and water will no longer flow. Timer 66 will activate solenoids 67 and 69, thereby allowing the liquid treating agents in storage tanks 17 and 21 to enter the dishwashing compartment 75. These liquid treating agents may be a rinsing aid and a chemical sanitizer. The purpose of the rinsing aid is to provide a sheeting action on the surface of the objects being cleaned. The purpose of the sanitizer is to kill bacteria and to disinfect the washed objects. Simultaneously, electric motor and pump 29 will be activated, circulating water from water supply line 42 through the spray arms 96 and 97, as previously described. After a pre-determined time, the dishwashing apparatus 1 automatically shuts off. The operator then opens door latch 71, allowing the doors to rise. The dish rack may be slid out through either door. The water from the previous cycle will remain in the reservoir pan 23 for use in washing in the next cycle.

The present invention is advantageous over other dishwashing machines because of the self-cleaning characteristics of the strainer and the higher efficiency of the spray arms. Liquid treating agents can be caustic. The present invention stores a larger amount of the liquid treating agents, and therefore, minimizes the handling and potential spillage of these potentially hazardous materials. The present invention places a constant pressure on the liquid treating agents, and therefore, controls the flow of the liquid treating agents more accurately and efficiently than in any previous system. The pressure system described herein maintains the constant pressure and eliminates insufficient or excessive dosages of the liquid treating agents into the dishwashing compartment 75. The proper dosage of the liquid treating agents is critical in providing the proper cleaning and sanitizing of the dishes, glasses, utensils, etc. for proper health and safety of the next users. The dishwashing apparatus 1 is easily serviceable and maintainable, and virtually free of the minor problems which might arise from abusive operators. The dishwashing apparatus 1 is made of heavy-duty materials in order to further provide durability and serviceability.

FIG. 6 is a bottom view of the upper spray arm 97 showing the North, South, East and West axes for reference for the point of entry for the spray nozzles. Spray nozzles 104–110 are located on upper spray arm 97. They are located at different points of entry in order to spray in differing directions for an appropriate water spray pattern within the dishwashing compartment 75. The location of the point of entry for each nozzle is defined in FIG. 6 by showing a North-South axis and an East-West axis. FIG. 13 is a nozzle placement chart. By referring to the nozzle placement chart, the exact point of entry of each nozzle can be found for a standard one inch (1") diameter spray arm. These points of entry will be proportionately different for spray arms of different diameters. In examining nozzle placement chart of FIG. 13, it is noted that the point of entry of the nozzles, with respect to the axes defined in FIG. 6, is as follows:

Nozzle 104 is South 5/32" and West 9 5/16";
Nozzle 105 is South 13/64" and West 7½;
Nozzle 106 is South ⅛" and West 4½;
Nozzle 107 is South 1/16" and West 1⅝";
Nozzle 108 is North 1/16" and East 1⅛";
Nozzle 109 is North 3/32" and East 6 3/16"; and
Nozzle 110 is East 9 5/32".

FIG. 7 is a side view of upper spray arm 97 showing the plus (+) and minus (−) axis for the primary angle of entry for the spray nozzles 104–110 on upper spray arm 97.

FIG. 8 is an end view from the plus (+) end of FIG. 7 showing the plus (+) and minus (−) axis for the secondary angle of entry for spray nozzle 110. The axes shown in FIG. 8 for spray nozzle 110 is the same axes for the secondary angle of entry for spray nozzles 104–110. The primary and secondary axes are defined from the center point of each point of entry. The primary axis is parallel to the previously defined East-West axis. The secondary axis is parallel to the previously defined North-South axis. The nozzle placement chart in FIG. 13 defines the primary and secondary angles for each spray nozzle 104–110. The combination of these two angles is the actual direction in which the spray nozzles are pointed. An examination of nozzle placement chart in FIG. 13 shows the directions of the spray nozzles being a combination of the following angles:

Nozzle 104 is in the direction of a primary angle of +2° and a secondary angle of +20°;
Nozzle 105 is in the direction of a primary angle of +2° and a secondary angle of +20°;
Nozzle 106 is in the direction of a primary angle of 0° and a secondary angle of +12°;
Nozzle 107 is in the direction of a primary angle of 0° and a secondary angle of +5°;
Nozzle 108 is in the direction of a primary angle of 0° and a secondary angle of −5°;
Nozzle 109 is in the direction of a primary angle of 0° and a secondary angle of −12°; and
Nozzle 110 is in the direction of a primary angle of 0° and a secondary angle of −5°.

FIG. 9 is a top view of lower spray arm 96 showing the North, South, East and West axes for the point of entry of the spray nozzles. Spray nozzles 111–117 are located on lower spray arm 96. They are located at different points of entry in order to spray in differing directions for an appropriate water spray pattern within the dishwashing compartment 75. The location for the point of entry for each nozzle is defined in FIG. 9 by showing a North-South axis and an East-West axis. FIG. 13 is a nozzle placement chart. By referring to the nozzle placement chart, the exact point of entry of each nozzle can be found for a standard one inch (1") diameter spray arm. These points of entry will be proportionately different for spray arms of different diameters. In examining nozzle placement chart of FIG. 13, it is noted that the point of entry of the nozzles, with respect to the axes defined in FIG. 9, is as follows:

Nozzle 111 is South 3/16" and West 9 7/16";
Nozzle 112 is South 3/16" and West 6½";
Nozzle 113 is West 3½";
Nozzle 114 is West 1⅜";
Nozzle 115 is East 2⅝";
Nozzle 116 is North ⅛" and East 5⅝"; and
Nozzle 117 is North 5/32" and East 8⅞".

FIG. 10 is a side view of lower spray arm 96 showing the plus (+) and minus (−) axes for the primary angle of entry for the spray nozzles 111–117 on lower spray arm 96.

FIG. 11 is an end view from the plus (+) end of FIG. 10 showing the plus (+) and minus (−) axes for the secondary angle of entry for spray nozzle 117. The axes shown in FIG. 11 for spray nozzle 117 is the same axes for the secondary angle of entry for spray nozzles 111–117. The primary and secondary axes are defined from the center point of each point of entry. The primary axis is parallel to the previously defined East-West axis. The secondary axis is parallel to the previously defined North-South axis. The nozzle placement chart in FIG. 13 defines the primary and secondary angles for each spray nozzle 111–117. The combination of these two angles is the actual direction in which the spray nozzles are pointed. An examination of nozzle placement chart in FIG. 13 shows the directions of the spray nozzles being a combination of the following angles:

Nozzle 111 is in the direction of a primary angle of −30° and a secondary angle of +20°;
Nozzle 112 is in the direction of a primary angle of −3° and a secondary angle of +20°;
Nozzle 113 is in the direction of a primary angle of 0° and a secondary angle of 0°;

Nozzle 114 is in the direction of a primary angle of 0° and a secondary angle of 0°;

Nozzle 115 is in the direction of a primary angle of +0° and a secondary angle of −13°;

Nozzle 116 is in the direction of a primary angle of +0° and a secondary angle of −13°; and Nozzle 117 is in the direction of a primary angle of +2° and a secondary angle of −0°.

The point of entry and the angle of entry of the spray nozzles provides a very efficient spray pattern in the dishwashing compartment 75. Applicant believes that this configuration of spray nozzles is more efficient than any known configuration of spray nozzles in any dishwashers with revolving spray arms. Minor changes in the point of entry and direction of the present configuration are within the scope of this invention and may be as effective, or exceed the efficiency of the exact configuration herein described.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A dishwashing apparatus utilizing liquid treating agents in dishwashing comprising:

(a) a dishwashing compartment operative to hold objects to be washed;

(b) a plurality of storage reservoir means operative to store said liquid treating agents in bulk quantities and physically secured onto said dishwashing apparatus;

(c) an air pressure means physically secured on said dishwashing apparatus operative to maintain a constant pressure on said liquid treating agents in said plurality of storage reservoir means physically secured on said dishwashing apparatus;

(d) connecting means secured between said plurality of said storage reservoir means and said dishwashing compartment and operative to provide a means for said liquid treating agents to flow under pressure from said air pressure means into said dishwashing compartment; and (e) flow switch means electrically controlled and operative to permit said liquid treating agents to flow under pressure from said air pressure means through said connecting means into said dishwashing compartment at pre-determined intervals.

2. A dishwashing apparatus according to claim 1 wherein said air pressure means comprises:

(a) air compressor means operative to take air from the atmosphere and increase the air pressure;

(b) air storage means connected to said air compressor means and operative to store said air;

(c) regulator means operative to reduce said air pressure in said air storage means to an operational level; and (d) a manifold receiving air pressure from said regulator means and distributing said air pressure to said plurality of said storage reservoir means, thereby placing a constant pressure on said liquid treating agents in said storage reservoir means.

3. A dishwashing apparatus according to claim 2 wherein said air pressure means further comprises switch means operative to control said air compressor means.

4. A dishwashing apparatus according to claim 3 wherein said air pressure means further comprises calibration means operative to monitor said air pressure in said air storage means.

5. A dishwashing apparatus according to claim 4 wherein said air pressure means further comprises manifold calibration means connected to said manifold and operative to monitor said air pressure at said manifold.

6. A dishwashing apparatus according to claim 5 wherein said air pressure means further comprises a pressure relief means connected to said manifold and operative to aid in maintaining a pre-designated pressure in said manifold.

7. A dishwashing apparatus according to claim 1 wherein said plurality of said storage reservoir means are physically located on said dishwashing apparatus above and below said dishwashing compartment.

8. A dishwashing apparatus according to claim 1 wherein said connecting means comprises a plurality of connectors, each secured to one of said plurality of storage reservoir means, and a cup with an opening into said dishwashing compartment, whereby said plurality of connectors provides a means for said liquid treating agents to flow into said cup and then into said dishwashing compartment.

9. A dishwashing apparatus according to claim 8 wherein said cup comprises an off-set device operative to allow said liquid treating agents to flow into said dishwashing compartment, while not allowing any liquids to flow back out through said cup from said dishwashing compartment.

10. A dishwashing apparatus according to claim 1 wherein said switch means comprises timer means controlling solenoid valve means which open at predetermined intervals to allow the flow of said liquid treating agents into said dishwashing compartment.

11. A dishwashing apparatus according to claim 1 wherein said dishwashing compartment comprises a bottom which is a reservoir pan operative to hold liquids.

12. A dishwashing apparatus according to claim 11 wherein said reservoir pan has a plurality of sloping bottoms and a drain valley at the intersection of each of said plurality of sloping bottoms.

13. A dishwashing apparatus according to claim 12 wherein said dishwashing compartment further comprises a sump in the lowest portion of said reservoir pan, wherein said drain valley terminates drain water into said sump.

14. A dishwashing apparatus according to claim 13 further comprising a plurality of filter means covering said sump.

15. A dishwashing apparatus according to claim 14 wherein said plurality of filter means comprises an upper filter screen with large openings and a lower filter screen with smaller openings.

16. A dishwashing apparatus according to claim 15 wherein said dishwashing apparatus further comprises water input means connected into said sump and operative to place water into said dishwashing compartment and to spray debris from said lower filter screen simultaneously, said water being sprayed in an opposite direction from the flow of said drain water which produced said debris on said lower filter screen.

17. A dishwashing apparatus according to claim 14 further comprising a plurality of ledges connected to said reservoir pan inside said sump and operative to support said pluraliity of filter means.

18. A dishwashing apparatus according to claim 13 further comprising a water supply line located at the bottom of said sump and operative for liquids to flow through when being re-circulated within said dishwashing compartment.

19. A dishwashing apparatus according to claim 1 wherein said dishwashing compartment further comprises a dump plunger which is inserted into a drain line connector, whereby when said dump plunger is seated in said drain line connector, liquids will remain in said dishwashing compartment, and when said dump plunger is removed from said drain line connector, said liquids in said dishwashing compartment will flow out through said drain line connector.

20. A dishwashing apparatus according to claim 19 wherein said dump plunger is hollow so that when liquids rise above said dump plunger, even when said dump plunger is seated in said drain line connector, said liquids will flow down through said hollow dump plunger and out of said dishwashing compartment, thereby the length of said dump plunger pre-determines the heighth of the liquid level in said dishwashing compartment.

21. A dishwashing apparatus according to claim 20 further comprising a sealing seat connected to the end of said dump plunger comprising sharply curved sides, whereby if said dump plunger falls on said drain line connector at an angle, a seal will still be effected between said dump plunger and said drain line connector.

22. A dishwashing apparatus according to claim 19 further comprising a guide connected to said reservoir pan inside said sump and operative to guide said dump plunger.

* * * * *